United States Patent [19]

Osborne

[11] 4,088,261

[45] May 9, 1978

[54] CONTAINER FOR TRASH COMPACTOR

[75] Inventor: Edward L. Osborne, Kansas City, Kans.

[73] Assignee: Westvaco Corporation, New York, N.Y.

[21] Appl. No.: 785,105

[22] Filed: Apr. 6, 1977

[51] Int. Cl.[2] ..... B65D 5/24

[52] U.S. Cl. ..... 229/26; 229/16 A; 229/31 R

[58] Field of Search ..... 229/31, 16 R, 16 A, 229/24, 26

[56] References Cited

U.S. PATENT DOCUMENTS

| | | | |
|---|---|---|---|
| 1,103,186 | 7/1914 | Feldmeyer | 229/26 |
| 1,383,173 | 6/1921 | Throop et al. | 229/24 |
| 2,138,700 | 11/1938 | Hoff | 229/31 R X |
| 2,514,073 | 7/1950 | Karlson | 229/26 |
| 2,676,747 | 4/1954 | Lange | 229/31 R |
| 2,783,933 | 3/1957 | Sharts | 229/37 R |
| 3,289,914 | 12/1966 | Lange-Wiehe | 229/31 R |
| 3,727,827 | 4/1973 | Stice | 229/37 R |

*Primary Examiner*—Davis T. Moorhead

[57] ABSTRACT

A container for use in a trash compactor is formed from a one piece substantially rectangular blank of paperboard that is cut and scored to provide leakproof, overlapping panel corner bellows folds and dimensions whereby the depth from top-to-bottom and length of the container from side-to-side are substantially equal while the width of the container from front-to-back is less than the other two dimensions.

1 Claim, 5 Drawing Figures

CONTAINER FOR TRASH COMPACTOR

BACKGROUND OF INVENTION

The container of the present invention is designed for use in an industrial compactor. The industrial compactor is a new concept for handling waste materials. Hospitals and supermarkets have particular problems with regard to waste disposal because almost all of their waste involves some liquid materials. For handling wet waste, the heretofore used multiwall bags for compactors are unsatisfactory. Accordingly, the solid wall container of the present invention provides a means for handling the wet waste without the leakage and premature rupture experienced with prior compactor bags. Moreover, the construction of the container disclosed herein is more suited to withstand the loads imposed by the trash compacting mechanism of the compactor than the prior compactor bags.

SUMMARY OF INVENTION

The container of the present invention is preferably die-cut from a substantially rectangular blank of paperboard or the like that is coated or impregnated to provide moisture impervious surfaces. An example of the type of paperboard useful for the present invention is COTE-A-COR 600 coated corrugated paperboard, a product of Westvaco Corporation, the assignee herein. However, the moisture impervious surface of the paperboard does not alone account for the absence of leakage and strength inherent in the container disclosed. To provide these latter desirable and necessary features, the blank is cut and scored to provide bellows like folds with overlapping panels at the corners and thus produce a liquid tight web corner construction. In this regard, the container of the present invention is formed from a blank which includes a substantially centrally located bottom panel with foldably attached side, front and rear walls wherein depth dimensions of said walls are not the same as in the case of conventional overlapping panel bellows style, web corner constructions (see for instance U.S. Pat. No. 3,904,106, U.S. Class 229/31R). The blank further includes corner connecting overlapping panels between the front rear and side walls, the intersecting edges of which are foldably attached respectively to the adjacent free edges of said walls, and, a plurality of top closure panels foldably attached to the front and rear walls and to two of said corner connecting panels adjacent to said rear wall. The corner connecting panels provide the bellows style web corners for the assembled container which produce a liquid tight bottom and give the container increased side wall strength and resistance to rupture under the pressures applied by the trash compacting mechanism. Each of the corner connecting panels contains the typical diagonal fold line utilized in the conventional bellows style, web corner constructions except that, in the present invention, the diagonal scores extend from the intersection of the foldable attachment of the front, rear and side walls to the bottom panel at a 45° angle to a free edge thereof which divides the corner connecting panels into two sections, i.e., a first triangular section adjacent a side wall and a second trapezoidal section adjacent a front or rear wall. This particular construction achieves for the present invention an overlapping panel bellows style, web corner container that has a height that is greater than the nominal height of the primary side walls of the container. Thus the construction herein is distinct from the conventional overlapping panel bellows style, web corner cartons and containers which have front, rear and side walls of the same nominal height.

In the assembled condition, the corner connecting panels of the container are folded along their diagonal scores so that the triangular sections thereof lie on opposite sides of the nominal side wall of the container between the trapezoidal sections thereof which form the inner and outer walls of the container. Accordingly, the triangular and trapezoidal sections of each corner connecting panel are disposed, in the assembled condition of the container, so that they each have a vertical edge aligned with the intersection of a side wall and a front or rear wall, but the horizontal edges of the respective corner connecting panel sections are not aligned but are offset one above the other. Thus, what is achieved with the present invention is as follows. The horizontal edges of the corner panel triangular sections become aligned with the horizontal edge of a side wall. Meanwhile, because the nominal side wall height is less than that of the trapezoidal sections, or front and rear walls, its horizontal edge is lower than the horizontal edges of the corner panel trapezoidal sections. The latter horizontal edges reach the same height as the front and rear walls to achieve in an overlapping bellows style, web corner construction a container having a depth from top-to-bottom substantially equal to the length from side-to-side but with a width from front-to-back that is less than the other two dimensions. As noted hereinbefore, with the prior art overlapping panel, bellows style web corner constructions, the width and depth of the container has always been dictated by and equal to the height of the container front, rear and side walls. Accordingly, for the purposes of the present invention, i.e., the production of a container for use in trash compactors, the desired additional depth but lesser width of the container is achieved with the die cut and scoring pattern disclosed and the folding sequence preferred.

Top closure flaps are also included on the container blank disclosed herein for the purpose of closing the container after it is filled for ultimate disposal. The latter flaps are foldably attached to the front and rear walls and to the outer trapezoidal sections of the corner connecting panels adjacent to the rear wall. In addition, means is provided between the top closure flaps on the two adjacent trapezoidal sections and the top closure flap connected to the rear wall in the form of bridge elements which serve to retain the top closure flaps in an upstanding condition until such time that the container is filled. Once the container is filled, the bridge elements are removed or broken so the top closure flaps can be selectively folded down and taped or strapped closed. Finally, when the preferred embodiment of the container is set up and assembled by the user, slots are provided at each side of the closure flap attached to the rear wall which permits the user to insert an anvil or other backing member inside the container when the overlapping bellows style corner connecting panels are secured to the sides walls by stitching, stapling or the like.

DETAILED DESCRIPTION

Figure 1:
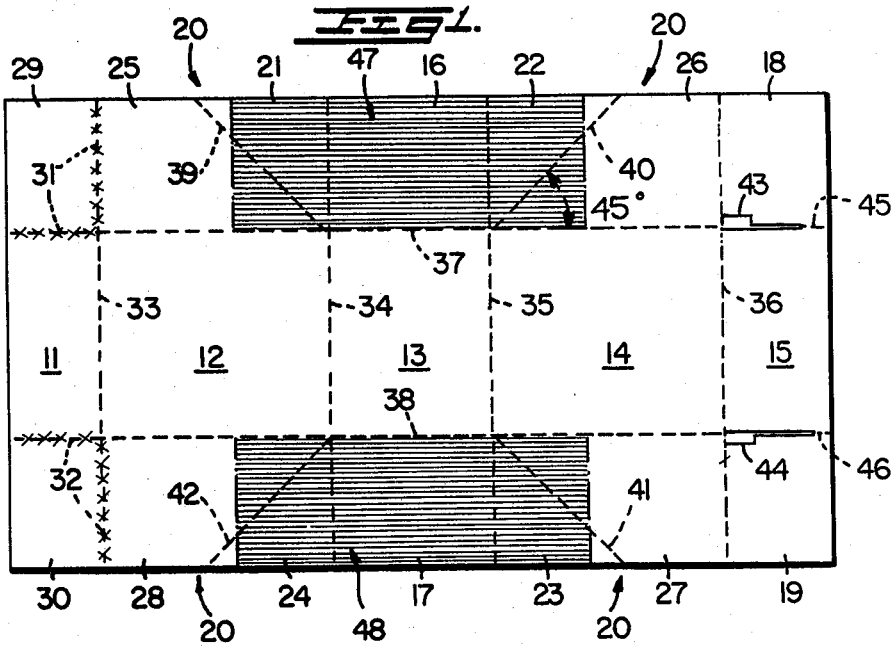
FIG. 1 is a perspective view of the preferred embodiment for the container blank of the present invention.

FIG. 1 illustrates the preferred blank for use in preparing the container of the present invention. The blank contains a substantially rectangular bottom panel 13, two side walls 16,17 foldably attached to opposite sides of the bottom panel along fold lines 37,38 and a front and rear wall 12,14 foldably attached to the remaining opposed sides of the bottom panel along the fold lines 34,35. The side, rear and front walls are also foldably attached to four corner connecting panel 20 along the fold lines 37,38 and 34,35 at two intersecting edges as shown. Each connecting panel 20 also contains a diagonal fold line 39,40, 41 and 42 which passes through the point of intersection of the connection between a corner connecting panels 20 and the respective side, rear and front walls and which extends at a 45° angle to a point along the outside edge of each connecting panel. The diagonal fold lines divide each connecting panel 20 into a triangular portion 21,22,23 and 24 attached to a side wall 16,17 and a trapezoidal portion 25,26,27 and 28 attached to a front or rear wall 12,14. Accordingly, the corner connecting panels 20 and the side walls 16,17 form the overlapping panel bellows type web corners for the container since they are each foldably connected to one another.

Joined to the trapezoidal portions 26,27 adjacent the rear wall 14 is a pair of top closure flaps 18,19 which cooperate with the top closure flap 15 joined to rear wall 14 along fold line 36 to close the top of the container. The top closure flaps 18,19 are further partially connected to the top closure flap 15 along cut extensions of the fold lines 37,38 with a bridge means 45,46 which keeps the top closure flaps from inadvertently collapsing while the container is in a compactor and being filled. Further, each of the top closure flaps 18,19 contain cutouts 43,44 located near the fold line 36 for the purpose of permitting the user to staple or stitch the bellows type overlapping foldable panels together.

Meanwhile, at the opposite end of the blank, the front wall 12 has attached thereto along fold line 33, an abbreviated front top closure flap 11. The dimensions for flap 11 are determined by the width of front wall 12 along fold line 33 and the ultimate width of the container from front-to-back as measured by the distance between fold lines 34,35. Thus, the length of flap 11 from score line 33 to its free edge could be no greater than the distance between fold lines 34,35 but it could be less as desired. The remainder of the blank including the edge flaps 29,30 is normally waste and is attached to flap 11 and trapezoidal portions 25,28 by the knicked score lines 31,32 with a knicked knife as well known in the trade. The knicked scores permit the flaps 29,30 to be easily removed when the container is set up and either thrown out or inserted in the bottom of the container to provide a double thick bottom. Meanwhile, the blank is preferably crushed in the shaded regions designated by the numerals 47,48 as an aid toward assuring a substantially flat folded condition for the various side wall panels.

Figure 2:
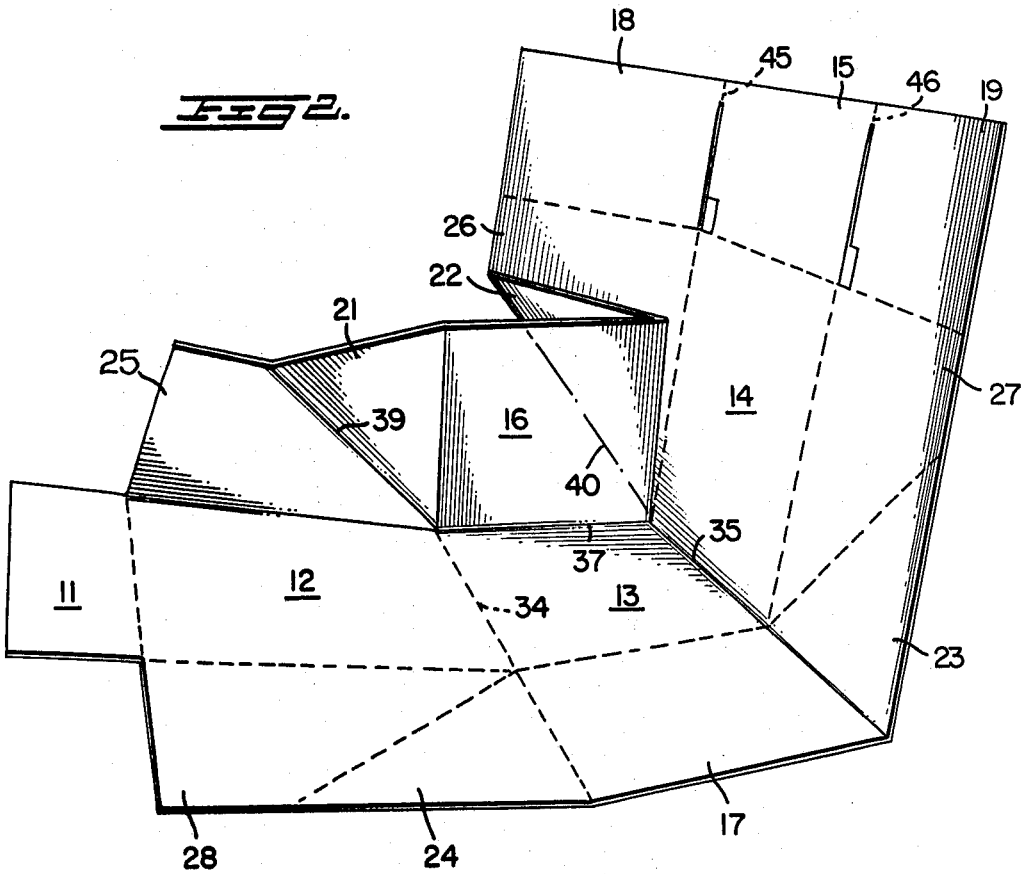
FIGS. 2–4 are perspective views showing how the blank of FIG. 1 is folded into an assembled container; and, FIG. 5 is a perspective view of the assembled container ready for insertion in a trash compactor.
Figure 3:
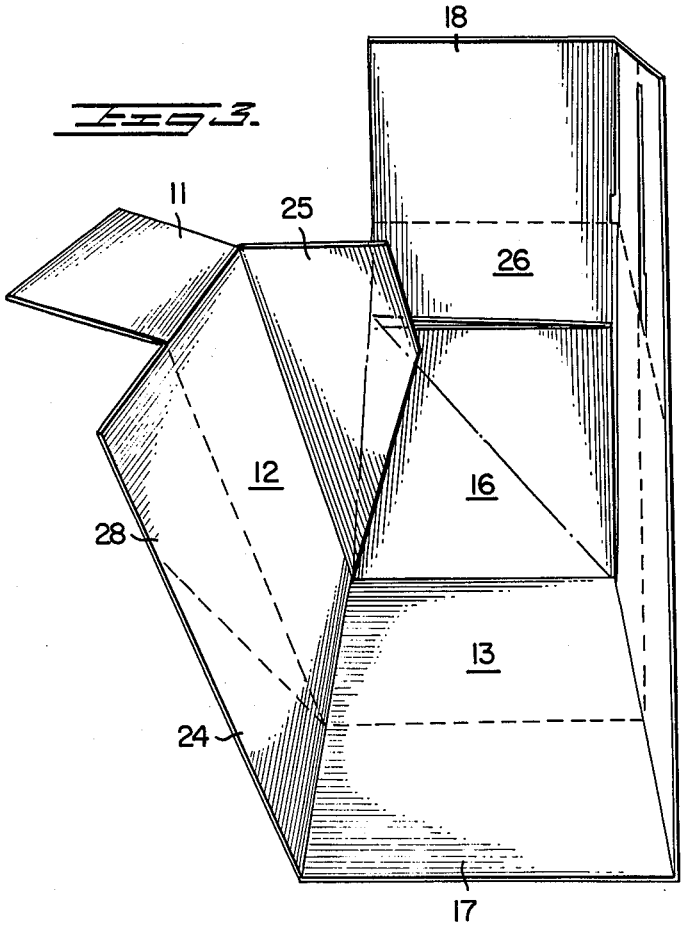

FIG. 2 illustrates a first step in the assembly of the container. The corner connecting panels 20 and side walls 16,17 are preferably numbered to show the preferred fold sequence which produces the most effective water tight construction. In particular, because the nominal height of the side walls 16,17 is less than the actual height of the container, it is necessary to fold the bellows type panels in such a manner that the side walls 16,17 become sandwiched between the trapezoidal portions 25,26 and 27,28. This construction achieves an interior with no exposed edges which could wick moisture to weaken the container. The ends of the container are generally formed one at a time and either stitched or stapled together with equipment normally used for such purpose. After the blank is laid out flat, the scores are flexed to aid in the ultimate folding steps. Where coated paperboard is used, care must be taken not to flex the scores too much lest the coating might be weakened to affect the moisture resistance of the board. With the blank in a flattened condition, rear wall 14 is folded upwardly about score line 37 while a reverse fold is applied to score line 35 between side wall 16 and the triangular portion 22 and a normal fold is applied to the diagonal score 40. This sequence places portion 22 of connecting panel 20 adjacent to and between portion 26 and side wall 16. Meanwhile front wall 12 is folded upwardly about score line 34 at the same time that the corner connecting panel 20 between front wall 12 and side wall 16 is applied with a reverse fold along score line 39 and a normal fold along the portion of score line 34 between side wall 16 and triangular portion 21. This sequence places the portion 21 of connecting panel 20 adjacent to and between portion 25 and side wall 16. FIG. 3 illustrates the continuation of the folding sequence wherein the two trapezoidal sections 25,26 of the connecting panels 20 at one side of the container form the inner and outer sides of the container while the side wall 16 and triangular portions 21,22 are sandwiched therebetween. Thus it may be seen that the preferred folding sequence achieves an interior with no exposed edges while the blank configuration produces an overlapping bellows style web corner bottom construction for a container that has side walls of greater height than the nominal height of the attached side wall panels. With the side wall and corner connecting panels 20 so assembled, the sides are stapled or stitched together to form a unit. For this purpose, stitching or staples can be applied to the front part by bending the front top closure flap 11 downward. However, the rear part can only be stapled or stitched by inserting the tool through the opening 43 provided therefor.

Figure 4:
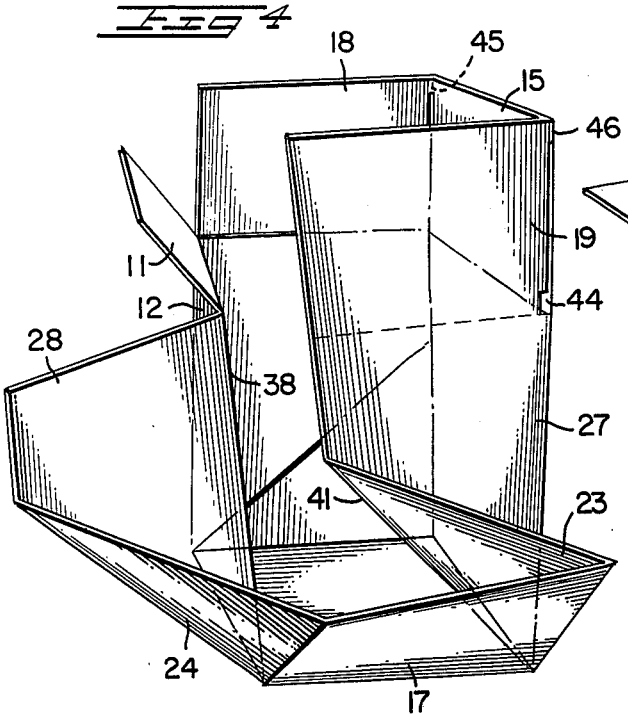

FIG. 4 shows the folding sequence for assembling the opposite side of the container. As will be seen, trapezoidal portion 27 becomes the interior wall of the container by applying a reverse fold along score line 41 and a normal fold along the extension of fold line 35 between side wall 17 and triangular portion 23. Meanwhile, a reverse fold is applied along the extension of fold line 34 between side wall 17 and triangular portion 24 as trapezoidal portion 28 is folded around about score line 38 to form the outer wall of the container. This sequence once again positions side wall 17 between the triangular portions 23,24 and adjacent to and between trapezoidal portions 27,28. Thus a side wall configuration that is reversed from the opposite side wall is achieved with the same desirable features, i.e., no exposed interior edges and side walls of greater height than the nominal height of the attached side wall panel 17. The second side is stapled or stitched in substantially the same manner as the first described above to produce a container ready for insertion in a compactor.

Figure 5:
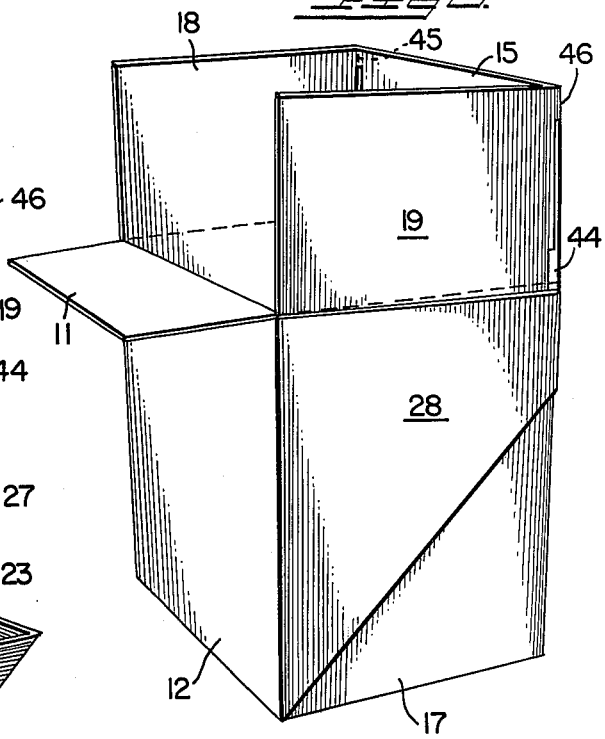

As noted hereinbefore, the top closure flaps 15,18 and 19 remain connected together during the folding sequence by the bridge members 45,46. The bridge members thus serve two purposes, i.e., to keep the top closure flaps from inadvertently folding over which could impede the assembly of the container, and to keep the flaps out of the way of the compactor mechanism. FIG. 5 illustrates the fully assembled container for use in a compactor. When the container is inserted in a compactor, the front wall flap 11 is folded downwardly outside of wall 12 to keep it free while the top closure flaps 15,18,19 remain erect and attached together via bridge members 45,46. After the container is filled with waste, it is removed from the compactor, the bridge members at 45,46 are broken and all top closure flaps 11,15,18 and 19 are folded over and the container is secured with tape or strapping material for ultimate disposal.

Accordingly, it may be seen that the container of the present invention is prepared from a blank of moisture resistant paperboard or the like wherein there is essentially no waste. The blank is rectangular in configuration and the portions 29,30 thereof which would normally be waste are generally used to reinforce the bottom of the container. Moreover, the need for providing a container to dispose of wet waste is achieved with the liquid tight web corner construction while the scoring pattern used produces a container of greater height than heretofore achieved with overlapping panel bellows type corner connecting panels.

To those skilled in the art to which the invention relates, many changes in construction and different embodiments and applications of the invention will suggest themselves without departing from the spirit and scope of the invention as defined in the appended claims.

I claim:

1. A bellows style container wherein the depth of the container is greater than the width of the container for use in a trash compactor or the like prepared from a single blank of corrugated paperboard comprising:

(a) a substantially centrally located rectangular bottom panel with foldably attached front, rear and side wall panels connected to the free edges thereof;

(b) a plurality of corner connecting panels between said front, rear and side wall panels, the intersecting edges of which are foldably attached respectively to the adjacent free edges of said side wall panels and said front and rear wall panels;

(c) a diagonal fold line in each corner connecting panel extending from the intersection of the foldable attachment between a side wall panel and a front and rear wall panel to a free edge thereof to divide the corner connecting panels into a first triangular section foldably attached to a side wall panel and a second trapezoidal section foldably attached to a front or rear wall panel wherein a liquid tight web corner construction is achieved when the corner connecting panels and side wall panels are folded such that the respective trapezoidal sections thereof form the inner and outer sides of the container by sandwiching therebetween the respective side wall and attached triangular sections and the horizontal edges of the corner connecting panel triangular sections become aligned with the horizontal edge of their attached side wall and the horizontal edges of the corner connecting panel trapezoidal sections become aligned with one another and disposed above the horizontal edges of said triangular sections and side walls;

(d) a plurality of top closure panels foldably attached to the remaining free edges of said front and rear wall panels and to the free edges of said trapezoidal sections attached to said rear wall panel; and, (e) means for retaining the top closure panel attached to said rear wall and the adjacent top closure panels attached to said trapezoidal sections in upstanding relation until said container is filled.

* * * * *